US011255009B2

(12) United States Patent
Behrens et al.

(10) Patent No.: US 11,255,009 B2
(45) Date of Patent: Feb. 22, 2022

(54) METHOD AND COATING DEVICE FOR COATING A METAL STRIP

(71) Applicant: Fontaine Engineering und Maschinen GmbH, Langenfeld (DE)

(72) Inventors: Holger Behrens, Erkrath (DE); Lutz Kümmel, Jüchen (DE); Thomas Daube, Duisburg (DE); Gernot Richter, Erkrath (DE); Babak Taleb-Araghi, Hürth (DE); Pascal Fontaine, Langenfeld (DE); Michael Zielenbach, Siegen (DE)

(73) Assignee: Fontaine Engineering und Maschinen GmbH, Langenfeld (DE)

( * ) Notice: Subject to any disclaimer, the term of this patent is extended or adjusted under 35 U.S.C. 154(b) by 204 days.

(21) Appl. No.: 16/327,876

(22) PCT Filed: Aug. 17, 2017

(86) PCT No.: PCT/EP2017/070872
§ 371 (c)(1),
(2) Date: Feb. 25, 2019

(87) PCT Pub. No.: WO2018/036908
PCT Pub. Date: Mar. 1, 2018

(65) Prior Publication Data

US 2019/0194791 A1 Jun. 27, 2019

(30) Foreign Application Priority Data

Aug. 26, 2016 (DE) ..... 10 2016 216 131.8
Nov. 11, 2016 (DE) ..... 10 2016 222 230.9

(51) Int. Cl.
*C23C 2/20* (2006.01)
*C23C 2/00* (2006.01)
(Continued)

(52) U.S. Cl.
CPC ..... *C23C 2/20* (2013.01); *C23C 2/003* (2013.01); *C23C 2/06* (2013.01); *C23C 2/14* (2013.01);
(Continued)

(58) Field of Classification Search
None
See application file for complete search history.

(56) References Cited

U.S. PATENT DOCUMENTS 3,518,109 A 6/1970 Halley
3,635,748 A 1/1972 Peoples
(Continued)

FOREIGN PATENT DOCUMENTS

CA 2794925 A1 5/2011
CN 102597295 A 7/2012
(Continued)

OTHER PUBLICATIONS

Machine Translation of JP-2002285309-A.*
(Continued)

*Primary Examiner* — David P Turocy
(74) *Attorney, Agent, or Firm* — Smartpat PLC

(57) ABSTRACT

The invention relates to a method for coating a metal strip with the aid of a coating device. Within the coating device, the strip first runs through a coating container with a liquid coating agent and then a stripping nozzle device for stripping off excess coating agent from the surface of the strip. After the stripping nozzle device, the strip typically runs through a strip stabilizing device with a plurality of magnets on both broad sides of the strip. A form control deviation is determined as the difference between a determined actual form of the strip and a specified desired form of the strip and this form control deviation is used for activating the magnets of the strip stabilizing device in order to transform the actual
(Continued)

form of the strip into the desired form. As an alternative possibility for producing a moment, in particular a bending moment, in the strip, on the basis of the form control deviation the magnets of the strip stabilizing device 130 are moved in the widthwise direction R of the strip 200 into a traversing position in relation to the magnets on the respectively opposite broad side of the strip.

18 Claims, 2 Drawing Sheets

(51) Int. Cl.

| | |
|---|---|
| ***C23C 2/36*** | (2006.01) |
| ***C23C 2/14*** | (2006.01) |
| ***C23C 2/18*** | (2006.01) |
| ***C23C 2/06*** | (2006.01) |
| ***C23C 2/40*** | (2006.01) |

(52) U.S. Cl.
CPC ..... *C23C 2/18* (2013.01); *C23C 2/36* (2013.01); *C23C 2/40* (2013.01)

(56) References Cited

U.S. PATENT DOCUMENTS

| | | | | |
|---|---|---|---|---|
| 3,661,116 | A | 5/1972 | Moskowitz et al. | |
| 3,778,122 | A | 12/1973 | Doll et al. | |
| 4,135,006 | A | 1/1979 | Readal et al. | |
| 4,444,814 | A | 4/1984 | Flinchum et al. | |
| 4,612,215 | A | 9/1986 | Hennechart et al. | |
| 5,384,166 | A * | 1/1995 | Sato | C21D 9/56 427/10 |
| 5,965,210 | A | 10/1999 | Tada et al. | |
| 8,062,711 | B2 | 11/2011 | Löfgren et al. | |
| 8,474,382 | B2 | 7/2013 | Bourgier et al. | |
| 10,190,203 | B2 | 1/2019 | Fontaine et al. | |
| 2003/0077397 | A1 | 4/2003 | Kabeya et al. | |
| 2004/0050323 | A1 | 3/2004 | Chae | |
| 2008/0044584 | A1 * | 2/2008 | Eriksson | C23C 2/003 427/430.1 |
| 2009/0191360 | A1 | 7/2009 | Teramoto et al. | |
| 2010/0209591 | A1 | 8/2010 | Eriksson et al. | |
| 2010/0285239 | A1 | 11/2010 | Behrens et al. | |
| 2011/0177258 | A1 | 7/2011 | Ernst et al. | |
| 2013/0232811 | A1 | 9/2013 | Koga et al. | |
| 2013/0319326 | A1 | 12/2013 | Guastini et al. | |
| 2013/0327806 | A1 * | 12/2013 | Jang | C23C 2/006 226/196.1 |
| 2014/0211361 | A1 | 7/2014 | Kurisu et al. | |
| 2017/0283929 | A1 | 10/2017 | Fontaine | |
| 2018/0155814 | A1 | 6/2018 | Fontaine et al. | |
| 2018/0363116 | A1 | 12/2018 | Fontaine | |
| 2019/0194791 | A1 | 6/2019 | Behrens et al. | |

FOREIGN PATENT DOCUMENTS

| | | | |
|---|---|---|---|
| CN | 202401120 | U | 8/2012 |
| CN | 205046185 | U | 2/2016 |
| DE | 2137850 | A1 | 2/1973 |
| DE | 102008039244 | A1 | 3/2009 |
| DE | 102007045202 | A1 | 4/2009 |
| DE | 102009051932 | A1 | 5/2011 |
| DE | 202015104823 | U1 | 10/2015 |
| DE | 102015216721 | | 11/2016 |
| JP | H08199323 | A | 8/1996 |
| JP | H10298727 | A | 11/1998 |
| JP | 2002285309 | A * | 10/2002 |
| JP | 2002285309 | A | 10/2002 |
| RU | 2482213 | C2 | 5/2013 |
| RU | 2557044 | C2 | 7/2015 |
| WO | 0111101 | A1 | 2/2001 |
| WO | 2006021437 | A1 | 3/2006 |
| WO | 2009039949 | A1 | 4/2009 |
| WO | 2012172648 | A1 | 12/2012 |
| WO | 2016078803 | A1 | 5/2016 |

OTHER PUBLICATIONS

Petter Lofgren et al., Electromagnetic Strip Stabilizer for Hot Dip Galvanizing Lines, Presented at the Galvanizers Association 97th Meeting Lexington, KY, Oct. 16-19, 2005.

Red Magnetics, "Pot Magnets", unknown publication date, retrieved online at https://www.red-magnetics.com/en/product-groups/others/pot-magnets/ on Nov. 4, 2019.

Rudolf Tremba, Elektromagnete—Topfmagnete, published online at http://www.magnetbasics.de/elektromagnete/topfmagnet.htm, Jul. 24, 2008, retrieved Oct. 30, 2019.

* cited by examiner

METHOD AND COATING DEVICE FOR COATING A METAL STRIP

TECHNICAL FIELD

The invention relates to a method for coating a metal strip with the help of a coating device. Within the coating device the strip runs through initially a coating container with a liquid coating medium, for example zinc, and subsequently a stripping nozzle device for stripping excess zinc from the surface of the metal strip. After the stripping nozzle device the strip typically runs through a strip stabilizing device with a plurality of magnets on the two wide sides of the strip.

BACKGROUND

Coating devices of that kind are known from, for example, WO2016/078803 A1.

In hot-dip galvanizing lines of the prior art the zinc coating thicknesses currently vary not only over the length, but also over the width of the strip. The layer thickness can in that case change by up to 10 g per $m^2$. Since minimum layer thicknesses have to be guaranteed, the mean layer thickness has to be settable so that all regions of the strip lie above the limit value. In order to reduce consumption of zinc, there is a desire to keep the fluctuation range as small as possible.

This objective is also pursued by European Patent Specification EP 1 794 339 B1. In order to achieve a uniform zinc coating over the strip width and length the European patent specification preferably provides a coordinated regulation of layer thickness, strip oscillation, strip shape and strip positioning. The oscillation regulation, also called strip stabilizing device, damps oscillations of the strip. It comprises magnet pairs which are preferably arranged as pairs over the strip width and are used as setting elements for positioning the strip. Each magnet pair is preferably equipped with a sensor for distance measurement and a regulator so that a force which varies over the strip width can be exerted on the strip in dependence on oscillation shapes which arise. In addition, the strip shape and strip position regulator damps the slow movements of the strip in that the mean force acting on the strip over the strip width is varied. In that case, each magnet pair is individually controlled, in particular electrically, with the help of the regulator. The individual regulators are coordinated with the help of a superimposed regulator which takes into consideration the interactions of the regulators amongst one another. In a preferred form of embodiment the position of at least one magnet is variable in such a way that the spacing thereof from the strip can be changed. The smaller the distance of the magnet from the strip, the less current or electrical energy is required in order to exert a desired force action on the strip. At the start of the coating process, when the oscillation amplitude of the strip is still relative large, a greater spacing of the magnets from the strip is required than in a steady state of the coating method in which the amplitude of the oscillations of the strip is smaller.

In the case of the juxtaposed arrangement of the magnets known from the European patent specification in principle only pure tension forces are exerted on the strip. It is possible through these pure tension forces to undertake variations of the strip position, i.e. changes in the actual position of the strip in both directions transversely to the strip. As already stated, strip movements and the actual position of the strip can be satisfactorily influenced in this way.

However, in order to provide compensation for strip curvatures such as, for example, a U-shape, S-shape or W-shape, a moment has to be exerted on the strip. According to EP 1 794 339 B1 this takes place in such a way that the superordinate coordinated regulator also takes into consideration the couples between the individual subordinate regulating circuits associated with the individual magnets. In other words, in this way the force effects between adjacent coils or coil pairs can be taken into consideration. Force and spacing produce a moment and thus a counter bending in the wave-shaped strip, which preferably counteracts any curvature of the strip, can be generated.

The invention has the object in the case of a known method and coating device for coating a strip of indicating an alternative possibility for producing a moment in the strip.

SUMMARY

This object is fulfilled by the method as claimed. This method is characterized in that the control of the magnets of the strip stabilizing device is carried out in that at least one of the magnets in dependence on the shape regulation difference in width direction of the strip is offset relative to at least one of the magnets at the opposite wide side of the strip and displaced into a moved position where it is at least approximately opposite a trough in the actual shape of the strip.

Thus, according to the invention, the pairwise arrangement, which is known from the prior art, for the individual magnets in opposition on the two wide sides of the strip is eliminated and the individual magnets of a (former) magnet pair are arranged to be offset relative to one another in width direction of the strip. Whereas in the case of a paired juxtaposition of the magnets the opposing forces of the two magnets act in a line and accordingly do not produce any torque, the offset of the individual coils of the (former) magnet pair in width direction in accordance with the invention produces a spacing between the forces acting in opposite directions, whereby a desired moment is generated in or on the strip. In this way, the said counter bending arises and it is accordingly possible in this way for the wave-shaped strips to be smoothed and converted into a planar strip.

According to the invention, at least individual ones of the magnets are so moved in width direction of the strip that they are at least approximately opposite a trough of the actual shape of the strip. In this arrangement, oppositely directed tension forces act at a spacing relative to one another on the metal strip and thus produce a desired bending moment for removing the curvatures or wave shape in the strip.

The expressions “strip” and “metal strip” are used synonymously. The expression “displaced in width direction” includes any desired movement of the magnet in space as long as the movement has a component in width direction of the metal strip.

The expression “downstream” means: in transport direction of the metal strip. Conversely, “upstream” means counter to the transport direction of the metal strip.

According to a first embodiment, in addition to the actual shape also the actual position of the strip within the stripping nozzle device can be determined, in addition to the shape regulation difference a position regulation difference as a difference between the actual position of the strip and a predetermined target position of the strip in the region of the stripping nozzle device can also be determined, and the displacement of the at least one magnet in width direction of the strip relative to the magnets on the opposite wide side of the strip can also be carried out in dependence on the position regulation difference so that the strip is transferred from its actual position to the predetermined target position.

According to a further embodiment a magnet pair or a plurality of magnet pairs is arranged in stationary position symmetrically with respect to the center of the slot of the strip stabilizing device or the center of the strip as seen in width direction, wherein the two magnets of the or each magnet pair are opposite one another at the two wide sides of the strip. If only one stationary magnet pair is provided, the expression "symmetrical" means that the magnet pair is arranged in the center. The stationary magnet pair forms or the stationary magnet pairs define a reference position. According to the invention, at least individual ones of the magnets adjacent to the stationary magnet pair are displaceable or movable in width direction of the strip relative to the at least one stationary magnet pair.

Thus, in particular, two further magnets forming a magnet pair can be displaced in such a way in the region of the left-hand or right-hand edge of the strip that that magnet of this magnet pair having the greater spacing from the edge of the strip is displaced with its center at the level of the edge and that that magnet of the magnet pair having the smaller spacing from the edge of the strip is arranged to be offset as seen in width direction—relative to the magnet with the greater spacing from the edge of the strip—some distance towards the center of the metal strip. This procedure is recommended not only for the left-hand, but also for the right-hand edge of the metal strip. In addition, in the case of this described procedure the juxtaposition of the two individual magnets of the magnet pair is eliminated in that these are offset relative to one another in width direction. As stated, the described procedure is recommended particularly for the edge regions of the metal strip, because it is often not possible to provide sufficient compensation for the strip curvatures, which frequently strongly vary thereat, by the traditional oppositely disposed magnets of a magnet pair or by the force action between adjacent magnet pairs. The offset in accordance with the invention of individual magnets of a magnet pair in width direction relative to one another is significantly more effective for this special case of use.

The expression "trough" describes the situation that the difference between the spacing of a magnet from the metal strip in its actual shape and the spacing of the magnet from the metal strip in its target shape—in each instance presupposing the same position of the metal strip—is greater than zero, in particular at a maximum. This means that the spacing between the magnet and the metal strip in the case of a trough is greater than if the metal strip were to have its target shape. The trough can then be "flattened down" by a tension force applied by the magnet or by a bending moment, which is applied by at least two magnets, on the metal strip.

It is to be noted that only tension forces, but not pressing forces, can be exerted on the metal strip by the magnets.

In the case of symmetrical wave-shaped actual shapes of the strip a movement of the magnets in width direction symmetrically with respect to the center of the strip is recommended.

The displacement of the magnets in the width direction can be carried out in dependence on the available number of magnets. In the case of a larger available number of magnets a finer resolution of the force action on the strip is possible, whereby compensation for the wave shape can be provided more precisely.

The displacement of the magnets in width direction can also be carried out in dependence on the force, which can be generated by the individual magnets, on the strip. This is available against the background that the moment generated in the strip is the product of force and spacing. Against this background, a specific desired magnitude of the moment can be generated by a selectable suitable setting of either the generated force or the spacing of the magnets from one another or of both.

The magnets are advantageously constructed in the form of electromagnetic coils, because the coils allow variable setting of the force on the metal strip in dependence on the supplied current. In addition to the influencing, which is claimed in accordance with the invention, of the position and shape of the strip by suitable displacement of individual magnets in width direction of the strip, the position and shape of the magnet can additionally also be carried out by a suitable action on or supply of the coils with appropriate currents. In concrete terms, in accordance with the invention, at least one of the coils is supplied with such a current that the strip by virtue of the force acting on the strip due to the current-conducting coils is transferred to its target position in the center of the stripping nozzle device and stabilized thereat and/or the actual shape of the strip is adapted as best possible to the target shape.

Apart from the displacement in accordance with the invention of individual magnets in width direction of the strip and the stated possibility for selection of suitable currents for the coils the positioning and adjustment of the correction roller also offers a further possibility for influencing the shape and position of the metal strip in the stripping nozzle device. In concrete terms, it is claimed in accordance with the invention that the correction roller is positioned and adjusted upstream of the stripping nozzle device in such a way that it is ensured the strip stabilizing device is operated only within its operating limits. In other words, through suitable positioning and adjustment of the correction roller there is the possibility of so presetting the position and/or shape of the metal strip in the slot of the stripping nozzle device that there is only such a small need for correction with respect to the shape and/or position of the metal strip that the magnets in the strip stabilizing device do not have to be operated with currents outside the operating limits thereof for realization of the correction. In addition, the residual need for correction for adaptation of the actual shape to the target shape and/or for adaptation of the actual shape of the strip to its target shape is then carried out in accordance with the invention by a suitable displacement of individual magnets in width direction as well as by supply of these magnets with a respectively suitable current.

The correction roller can be appropriately moved not only before the movement of the magnets, but also during an ongoing coating process, as described in the preceding paragraph. In addition, the correction roller can be positioned and adjusted not just for presetting the position and shape of the strip. Rather, the correction roller can also be automatically so positioned and adjusted that in the case of exceeding predetermined force limits on the strip in the strip stabilizing device the forces again lie in a target range. This is required particularly in the case of product changes, i.e. in the case of transition to strips with different thicknesses or different materials with different yield strengths. In addition, the correction roller can be automatically moved in such a way that it gives defined directions of action of the forces at the magnets so as to ensure a unilateral or monotonic introduction of force.

Finally, it is provided in accordance with the invention that the moved positions of the magnets in width direction, the currents by which the coils are acted on and/or the position and the adjustment of the correction roller are stored in a database. In that case, the storage is preferably carried out with classification according to the steel category of the strip, the yield strength of the strip, the thickness of the strip, the width of the strip, the temperature of the strip during transit through the coating device and/or according to the temperature of the coating medium in the coating container during transit of the strip. Through storage of these data, better starting values in the case of future coating processes can be determined particularly through the moved positions of the magnets in width direction of the new strips to then be coated.

The above-mentioned object is further fulfilled by a coating device as claimed. The advantages of this coating device correspond with the advantages mentioned above with reference to the method according to the invention.

BRIEF DESCRIPTION OF THE DRAWINGS

Four figures accompany the description, wherein.

DETAILED DESCRIPTION

Figure 1:
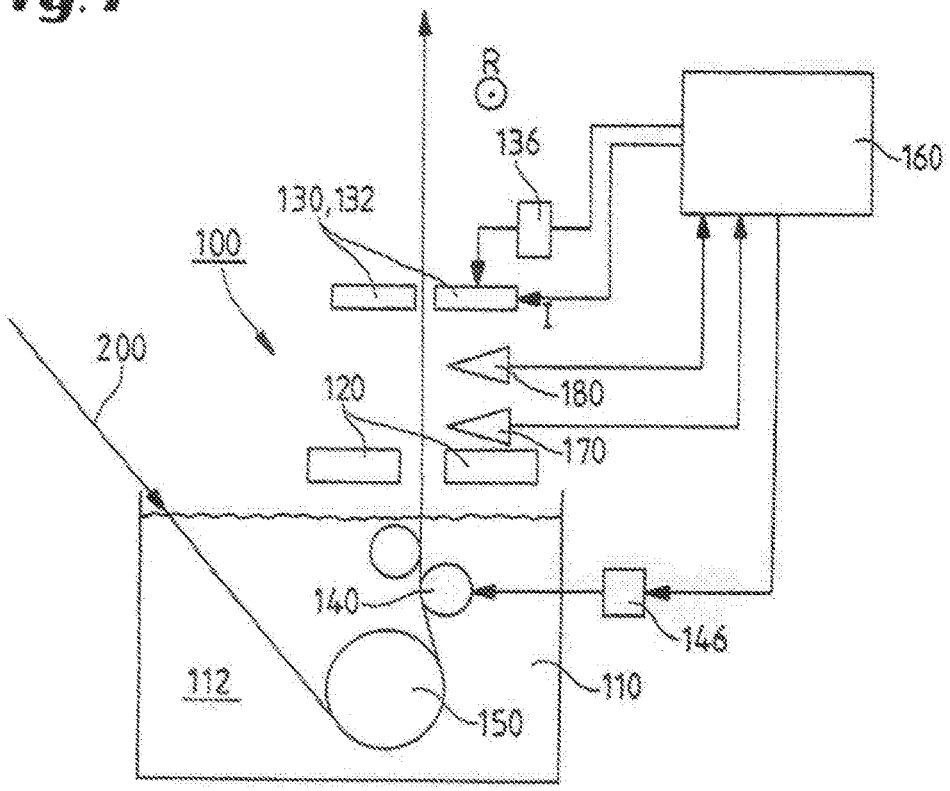
FIG. 1 illustrates a coating device.

The coating device according to the invention and the method according to the invention are described in detail in the following in the form of embodiments with reference to the stated figures. In all figures the same technical elements are denoted by the same reference numerals.

FIG. 1 shows a coating device 100 for coating a metal strip 200. The coating device 100 includes a coating container 110 filled with liquid coating medium 112, for example zinc. The metal strip 200 dips into the coating container and is there deflected in the liquid coating medium with the help of a pot roller 150. The metal strip 200 is then led past a correction roller 140 and subsequently through the slot of a stripping nozzle device 120 and further subsequently through the slot of a strip stabilizing device 130. Within the stripping nozzle device 120 the strip is acted on preferably at both sides with an air flow so as to strip off excess liquid coating medium.

The strip stabilizing device 130 includes of a plurality of magnets 132 arranged at the two wide sides of the strip or strip stabilizing device. These magnets 132 are typically constructed in the form of electromagnetic coils. The coating device 100 additionally comprises a control device 160 for controlling an actuator 136 for displacing or moving the magnets 132 in accordance with the invention in width direction R of the strip and for setting the current I fed to the individual magnets. In addition, the control device can have an output for controlling an actuator 146 for positioning and adjusting the correction roller 140. The control of the actuators 136, 146 as well as the setting of the current for the magnets take place in dependence on measurement signals of a distance sensor preferably traversing in width direction of the strip. The distance sensor detects the distribution of the spacing of the metal strip in width direction with respect to a reference position, for example the gap or slot of the strip stabilizing device. In this way, there is detection of the actual shape and/or the actual position of the metal strip. Alternatively, a separate shape sensor 170 for detecting the actual shape of the strip and a separate position sensor 180 for detecting the actual position of the metal strip can be provided.

Determination of the actual position and/or actual shape of the metal strip within the stripping nozzle device 120 is carried out by measuring the position and/or shape of the strip either between the stripping nozzle device 120 and the strip stabilizing device 130 or within the strip stabilizing device 130 or upstream of the strip stabilizing device 130 and by subsequently drawing a conclusion about the actual position and/or the actual shape of the strip within the stripping nozzle device from the respectively measured position and/or shape of the strip. In that case, determination of the actual position and/or actual shape of the strip within the strip stabilizing device 130 is carried out by measuring the spacing of the strip from the magnets of the strip stabilizing device over the width of the strip.

Figure 2:
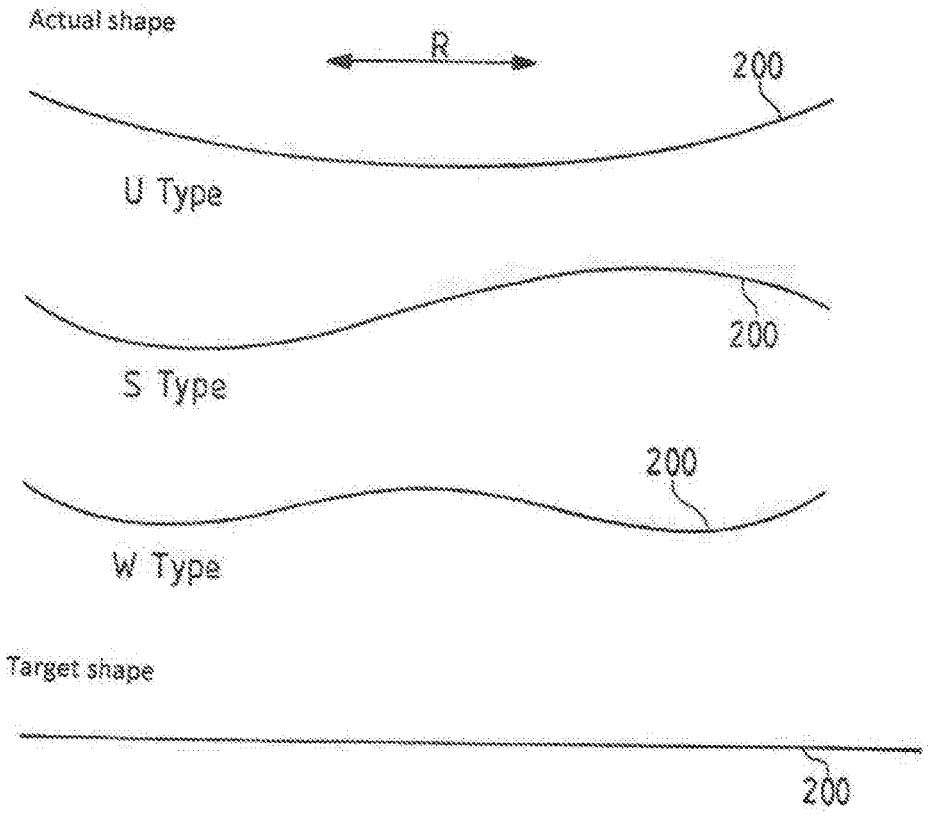
FIG. 2 illustrates known actual shapes and a known target shape of the strip.

FIG. 2 shows different examples for possible undesired actual shapes of the metal strip 200, in concrete terms a metal strip wavy in U-shape, S-shaped and W-shape. By contrast, in the lower region FIG. 2 shows the desired target shape of the metal strip 200. Accordingly, the metal strip in its target shape is formed to be straight or planar.

Figure 3:
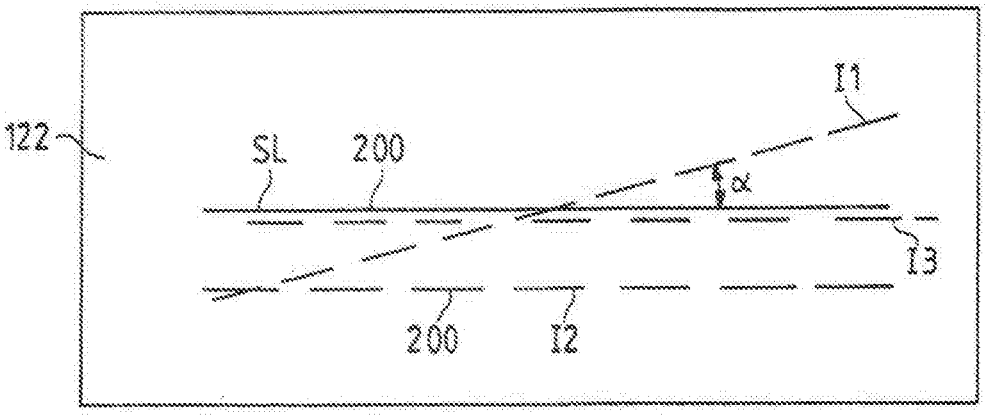
FIG. 3 illustrates known actual and target positions of the strip.

FIG. 3 shows different undesired actual positions of the metal strip 200 in the slot 122 of the stripping nozzle device 120. The different actual positions are illustrated in dashed lines, whereas the target position SL is illustrated by a continuous dash. In concrete terms, the target position is distinguished by the fact that the metal strip 200 has a uniform spacing from the sides of the slot 122. By contrast, in a first undesired actual position I1 relative to the target position SL the metal strip can be twisted or swiveled through an angle $\alpha$. A second undesired actual position I2 of the metal strip consists of the metal strip being displaced parallelly relative to the target position SL so that the metal strip no longer has equal spacings from the wide sides of the slot. Finally, a third typical undesired actual position for the metal strip consists in that the metal strip in accordance with the position I3 is displaced in longitudinal direction relative to the target position SL so that its spacings from the narrow sides of the slot 122 of the stripping device are no longer equal.

Figure 4:
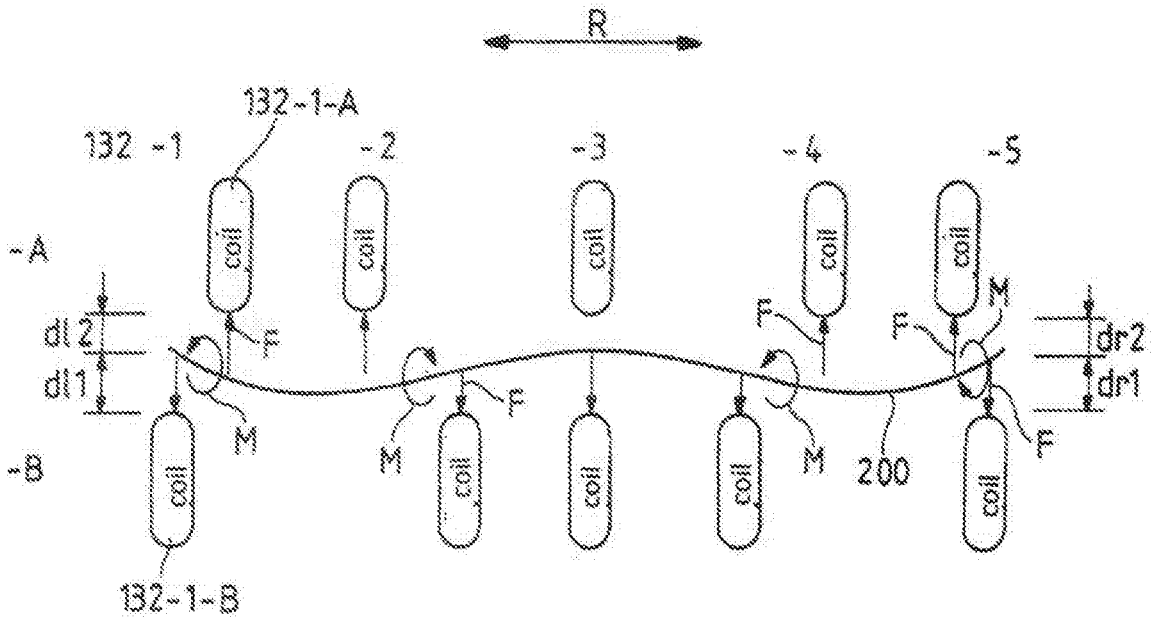
FIG. 4 illustrates movement in accordance with the invention of magnets in width direction of the strip.

FIG. 4 illustrates the method according to the invention. After determination of the actual shape of the strip 200 within the stripping nozzle device 120 over the width of the strip, for example in the form of the types shown in FIG. 2 at the top, the actual shape is compared with a predetermined target shape of the strip, typically as shown in FIG. 2 at the bottom. The departures in shape form a shape regulation difference and the magnets 132 of the strip stabilizing device 130 are so controlled in dependence on the shape regulation difference that the actual shape of the strip is converted into the target shape of the strip. In that case, according to the invention at least individual ones of the magnets 132 are displaced in width direction R of the strip 200 relative to the magnets on the respective opposite wide side of the strip into a moved position. These moved positions are illustrated by way of example in FIG. 4.

In addition to the actual shape, the actual position of the strip 200 within the stripping nozzle device 120 can also be determined. Undesired manifestations of this actual position were already presented above with reference to FIG. 3. In addition to the shape regulation difference, analogously also a position regulation difference as a difference between the actual position of the strip and a predetermined target position SL in the region of the stripping nozzle device 120 can be determined. The displacement of the at least one magnet 132-A in width direction R of the strip 200 relative to the magnets 132-B on the opposite wide side of the strip 200 can accordingly also be carried out in such a way in dependence on the position regulating difference that the strip is transferred from its actual position to the predetermined target position SL.

In general, it is feasible that at least individual ones of the current-conducting, i.e. active, magnets 132 are so moved in width direction R of the strip 200 that in their moved position, also called end position, they are at least approximately opposite a trough in the actual shape of the strip 200, as illustrated in FIG. 4. The advantage of this procedure is that the forces, which act in different directions, of the individual coils act at a spacing from one another and thus a torque or bending moment on the strip 200 can be generated to provide compensation for, in particular, transverse curvatures or undesired wave shapes. The bending moments generated by the forces F of the coils are denoted in FIG. 4 by the reference sign M.

FIG. 4 shows a special embodiment for possible moved positions. In concrete terms, in this embodiment a magnet pair 132-3-A, 132-3-B is arranged in stationary position in the center of the strip 200 as seen in width direction R. The two magnets of this magnet pair are mutually opposite at the two wide sides A, B of the strip 200. By contrast, the remaining coils or magnets are not arranged in the form of magnet pairs of which the individual magnets 132-1, 132-2, 132-4 and 132-5 are directly opposite. These remaining magnets are arranged to be displaced or offset in width direction R of the strip relative to the magnets on the other strip side.

In concrete terms, two further magnets 132-1-A and 132-1-B form a left-hand magnet pair which is displaced in the region of the left-hand edge of the strip 200 in such a way that that magnet 132-1-B of the left-hand magnet pair having the greater spacing $d_{l1}$ from the edge of the strip is displaced with its center at the level of the left-hand edge and that magnet 132-1-A of the left-hand magnet pair having the smaller spacing $d_{l2}$ from the left-hand edge of the strip is arranged to be displaced—relative to the magnet 132-1-B with the greater spacing $d_{l1}$ from the edge of the strip—some distance towards the stationary magnet pair 132-3-A, 132-3-B, i.e. towards the strip center. Through the offset arrangement of the two part coils 132-1-A and 132-1-B of the left-hand coil pair the torque shown in FIG. 4 is exerted on the left-hand edge region of the strip 200 in anticlockwise sense, whereby the transverse curvature thereof at that place can be eliminated.

Alternatively or additionally a right-hand magnet pair 132-5-A, 132-5-B can be provided, which is displaced in such a way in the region of the right-hand edge of the strip 200 that its part magnet 132-5-B having the greater spacing $d_{r1}$ from the right-hand edge of the strip 200 is displaced with its center at the level of the right-hand edge. In addition, then that part magnet 132-5-A of the right-hand magnet pair having the smaller spacing $d_{r2}$ from the right-hand edge of the strip is offset—relative to the magnet with the greater spacing from the edge of the strip—some distance towards the center of the strip 200. In this case, the tension forces F which are generated in FIG. 4 by the part coils and which act at a spacing from one another on the strip 200 produce a bending moment M in clockwise sense on the strip 200. As a result, compensation can be provided for the wave shape, which is additionally shown in FIG. 4, at the right-hand edge.

The remaining magnets 132-2-A, 132-2-B, 132-4-A and 132-4-B, which do not belong to the right-hand, left-hand or middle magnet pair, are preferably so moved in width direction R of the strip 200 that they are each at least approximately opposite a trough in the actual shape of the strip, as is illustrated in FIG. 4, whereby the above-described advantageous effect by generation of the bending moments is achieved.

As can be similarly seen in FIG. 4, particularly in the case of a symmetrical undesired actual shape of the strip, when the said displacement of the magnets in width direction takes place the symmetrical arrangement of the magnets shown in FIG. 4 is created, particularly the symmetrical arrangement with respect to the stationary magnet pair 132-3-A, 132-3-B.

REFERENCE NUMERAL LIST

100 coating device
110 coating container
112 coating medium
120 stripping nozzle device
122 slot of the stripping nozzle device
130 strip stabilizing device
132 magnet
136 actuator
140 correction roller
150 pot roller
160 control device
170 shape sensor
180 position sensor
200 metal strip
$d_{l1}$ spacing
$d_{l2}$ spacing
$d_{r1}$ spacing
$d_{r2}$ spacing
F force
l1 inclined setting
l2 parallel displacement
l3 offset
M bending moment
R width direction
SL target position
α angle

The invention claimed is:

1. A method for coating a metal strip with the help of a coating device, in which the metal strip is led through a coating container with a liquid coating medium, subsequently through a slot of a stripping nozzle device and further subsequently through a slot of a strip stabilizing device with a plurality of magnets on both wide sides of the strip, comprising the following steps:

determining an actual shape of the metal strip within the stripping nozzle device over a width of the metal strip;

determining a shape regulation difference as a difference between the actual shape of the metal strip and a predetermined target shape of the metal strip in a region of the stripping nozzle device; and controlling the plurality of magnets of the strip stabilizing device as setting elements so that the actual shape of the metal strip is converted into the target shape of the strip, wherein controlling the plurality of magnets of the strip stabilizing device is carried in that at least one of the magnets, in dependence on the shape regulation difference, is displaced in a width direction (R) of the metal strip to be offset relative to all of the magnets on the opposite wide side of the metal strip and displaced into a moved position where it is at least approximately opposite a trough in the actual shape of the metal strip, and wherein the plurality of magnets on both wide sides of the strip are arranged in a plane perpendicular to a traveling direction of the metal strip.

2. The method according to claim 1, wherein in addition to the actual shape, an actual position of the metal strip within the stripping nozzle device is determined;

in addition to the shape regulation difference, a position regulation difference as difference between the actual position of the strip and a predetermined target position of the metal strip in the region of the stripping nozzle device is determined; and the displacement of the at least one of the magnets in the width direction (R) of the metal strip relative the at least one magnet on the opposite wide side of the metal strip is also carried out in dependence on the position regulation difference so that the strip is transferred from its actual position to the predetermined target position.

3. The method according to claim 1, wherein, as seen in width direction, a stationary magnet pair or a plurality of stationary magnet pairs is arranged in a stationary position symmetrically with respect to a center of the slot of the strip stabilizing device or a center of the metal strip, wherein two magnets of the stationary magnet pair or each of the stationary magnet pairs are arranged to be opposite at the two wide sides of the metal strip; and wherein at least individual ones of magnets adjacent to the at least one stationary magnet pair are so displaced relative to the stationary magnet pair in width direction (R) of the metal strip that in their moved position they are at least approximately opposite a trough in the actual shape of the strip.

4. The method according to claim 1, wherein the displacement of the at least one magnet in width direction (R) is carried out symmetrically with respect to a strip center.

5. The method according to claim 1, wherein two further magnets form a left-hand magnet pair which is so displaced in a region of a left-hand edge of the metal strip that that magnet of the left-hand magnet pair having a greater spacing ($d_{l1}$) from the edge of the metal strip is displaced with its center at the level of the left-hand edge and that magnet of the left-hand magnet pair having a smaller spacing ($d_{l2}$) from the left-hand edge of the metal strip is arranged to be so offset as seen in width direction towards the center of the metal strip that it is at least approximately opposite a trough in the actual shape of the strip;

and/or wherein two further magnets form a right-hand magnet pair which is so displaced in a region of a right-hand edge of the metal strip that that magnet of the right-hand magnet pair having a greater spacing ($d_{r1}$) from the edge of the metal strip is displaced with its center at the level of the right-hand edge and that magnet of the right-hand magnet pair having a smaller spacing ($d_{r2}$) from the right-hand edge of the strip is arranged to be so offset as seen in width direction towards the center of the metal strip that it is at least approximately opposite a trough in the actual shape of the strip.

6. The method according to claim 5, wherein remaining magnets not belonging to the right-hand, left-hand or middle magnet pair are so moved in width direction (R) of the metal strip that they are each at least approximately opposite a trough in the actual shape of the strip.

7. The method according to claim 1, wherein determination of the actual position and/or the actual shape of the metal strip within the stripping nozzle device is carried out by measuring the position and/or shape of the strip either between the stripping nozzle device and the strip stabilizing device or within the strip stabilizing device or downstream of the strip stabilizing device and by determining the actual position and/or the actual shape of the strip within the stripping nozzle device from the measured position and/or shape of the strip.

8. The method according to claim 7, wherein determination of the actual position and/or the actual shape of the strip within the strip stabilizing device is carried out by measuring a spacing of the strip from the magnets of the strip stabilizing device over the width of the strip.

9. The method according to claim 1, wherein the displacement of the magnets in the width direction (R) is additionally carried out in dependence on an available number of magnets at each of the wide sides of the metal strip.

10. The method according to claim 1, wherein the displacement of the magnets in width direction (R) is carried out in dependence on a force (F), which can be generated by individual magnets, on the metal strip.

11. The method according to claim 1, wherein the magnets are electromagnetic coils.

12. The method according to claim 11, wherein at least one of the coils is supplied with such a current that the metal strip by reason of a force (F) acting through the electromagnetic coil on the metal strip is transferred to its target position in the center of the stripping nozzle device and stabilized thereat and/or the actual shape of the strip is adapted as best possible to the target shape.

13. The method according to claim 1, wherein a correction roller is so positioned and adjusted upstream of the stripping nozzle device that the strip stabilizing device and the magnets thereof can be operated within their operating limits.

14. The method according to claim 1, wherein the actual shape of the metal strip has an S-shaped or U-shaped or W-shaped cross-section of the metal strip.

15. The method according to claim 1, wherein the target shape of the metal strip has a rectangular cross-section or planarity of the metal strip.

16. The method according to claim 1, wherein the actual position of the metal strip is an inclined setting (I1) or a parallel displacement (I2) or an offset (I3) of the metal strip relative to the target position (SL) in the slot of the stripping nozzle device.

17. The method according to claim 1, wherein the target position (SL) of the strip is a center position in the slot of the stripping nozzle device.

18. The method according to claim 1, wherein moved positions of the magnets in width direction (R), currents acting on electromagnetic coils and/or a position and adjustment of a correction roller are stored in a database.

* * * * *